United States Patent [19]

Satoh et al.

[11] Patent Number: 4,983,890

[45] Date of Patent: Jan. 8, 1991

[54] ROTATING DRIVE DEVICE

[75] Inventors: Yasuta Satoh, Nagareyama; Shigeru Nakane, Narashino; Hitoshi Yoneyama, Saitama, all of Japan

[73] Assignee: Takara Co., Ltd., Tokyo, Japan

[21] Appl. No.: 411,672

[22] Filed: Sep. 25, 1989

[30] Foreign Application Priority Data

| | | | |
|---|---|---|---|
| Sep. 29, 1988 | [JP] | Japan | 63-245338 |
| Feb. 21, 1989 | [JP] | Japan | 1-41341 |
| Feb. 21, 1989 | [JP] | Japan | 1-41342 |
| Feb. 21, 1989 | [JP] | Japan | 1-41343 |

[51] Int. Cl.[5] ..... G09F 19/08; A63H 13/02

[52] U.S. Cl. ..... 318/3; 318/14; 318/15; 446/175; 40/414

[58] Field of Search ..... 318/3, 9, 12, 14, 15, 318/16, 17; 446/58, 82, 83, 84, 99, 100, 101, 154, 158, 175, 281, 282, 352, 353, 354, 357, 358, 454, 456, 457, 462, 471, 484, 491; 40/411, 414

[56] References Cited

U.S. PATENT DOCUMENTS

| | | | |
|---|---|---|---|
| 1,916,988 | 7/1933 | Pieschke . | |
| 3,672,082 | 6/1972 | Tepper et al. | 446/83 X |
| 3,768,199 | 10/1973 | Goldfarb | 446/357 |
| 3,878,521 | 4/1975 | Licitis et al. | 446/454 X |
| 4,086,724 | 5/1978 | McCaslin | 446/175 |
| 4,165,581 | 8/1979 | Wolf | 446/175 |
| 4,169,335 | 10/1979 | Betancourt . | |
| 4,180,932 | 1/1980 | Millard . | |
| 4,272,918 | 6/1981 | Inoue | 446/175 X |
| 4,344,243 | 8/1982 | Reszka | 446/83 X |
| 4,450,650 | 5/1984 | Holden et al. | 446/99 X |
| 4,459,776 | 7/1984 | Jaworski et al. | 446/462 |
| 4,804,348 | 2/1989 | Bondi | 446/83 |
| 4,903,424 | 2/1990 | Satoh et al. . | |

*Primary Examiner*—Bentsu Ro

*Attorney, Agent, or Firm*—Price, Gess & Ubell

[57] ABSTRACT

A rotating drive device capable of exhibiting a variety of applications and/or diversities and being easily assembled. The rotating drive device includes a drive mechanism unit and a transmission mechanism unit operatively connected to the drive mechanism unit. The drive mechanism unit includes a casing, in which a power supply, a sensor and a motor are arranged. The drive mechanism unit also includes an output shaft which is operatively connected to the motor and through which the transmission mechanism unit is connected to the drive mechanism unit. The motor is electrically connected to the power supply and sensor so as to be actuated when the sensor detects an external stimulus. The transmission mechanism unit includes an input section operatively connected to the output shaft of the drive mechanism unit to transmit the drive force of the drive mechanism unit to the transmission mechanism unit and a plurality of output sections for transmitting the power of the transmission mechanism unit to the exterior.

4 Claims, 10 Drawing Sheets

ROTATING DRIVE DEVICE

BACKGROUND OF THE INVENTION

This invention relates to a rotating drive device, and more particularly to a rotating drive device which is adapted to exhibit various kinds of applications and diversities in a variety of fields such as in the field of a movable decorative ornament.

Recently, a movable decorative ornament has been proposed and widely put to practical use, which is so constructed that a hollow member constituting a decoration in cooperation with a decoration body mounted on the distal end of the hollow member is loosely fitted on a flexible core element rotatably mounted on a base and is fixed at the proximal end thereof on the base. In the so-constructed movable decorative ornament, the core element is rotated through a rotating drive device, to thereby move the decoration body together with the hollow member in a meandering manner.

Unfortunately, the rotating drive device for the movable decorative ornament is not constructed so as to exhibit applications and/or diversities sufficient to vary the motion of the decoration in various manners, resulting in the ornament being apt to lose its popularity with the lapse of time.

Also, the conventional rotating drive device includes a reduction motor unit or output unit which is integrally constructed by receiving a motor in a cylindrical housing and integrally connecting an output shaft of the motor to a reduction gear mechanism comprising a plurality of gears. However, the output unit and therefore the drive device are highly troublesome in assembling and fail to be small-sized.

Accordingly, it would be highly desirable to develop a rotating drive device which is capable of exhibiting a variety of applications and/or diversities and being easily assembled.

SUMMARY OF THE INVENTION

Generally speaking, in accordance with one aspect of the present invention, a rotating drive device is provided which is effectively applied to, for example, a movable decorative ornament. The rotating drive device includes a casing, in which a power supply, a sensor and a motor are arranged. The motor is electrically connected to the power supply and sensor so as to be actuated when the sensor detects an external stimulus such as sound, heat or the like. The device also includes an output shaft operatively connected to motor and arranged in a manner to project at the distal end thereof from the casing. The distal end of the output shaft is provided with a connection.

In accordance with the present invention, there is also provided a rotating drive device which includes a drive mechanism unit and a transmission mechanism unit operatively connected to the drive mechanism unit. The drive mechanism unit includes a casing, in which a power supply, a sensor and a motor are arranged. The drive mechanism unit also includes an output shaft which is operatively connected to the motor and through which the transmission mechanism unit is connected to the drive mechanism unit. The motor is electrically connected to the power supply and sensor so as to be actuated when the sensor detects an external stimulus. The transmission mechanism unit includes an input section operatively connected to the output shaft of the drive mechanism unit to transmit the drive force of the drive mechanism unit to the transmission mechanism unit and a plurality of output sections for transmitting the power of the transmission mechanism unit to the exterior.

In accordance with another aspect of the present invention, an output unit for a rotating drive device is provided. The output unit includes a casing, in which a power supply, a sensor and a motor are arranged. The motor is electrically connected to the power supply and sensor so as to be actuated when the sensor detects an external stimulus. The output unit further includes an output shaft operatively connected to the motor and arranged in a manner to project at the distal end thereof from the casing. The distal end of the output shaft is provided with a connection.

In accordance with the present invention, there is also provided an output unit for a rotating drive device, which includes a motor, a reduction gear section comprising a plurality of gears to which the drive force of the motor is transmitted, and an output shaft for outputting the drive force of the motor transmitted through the reduction gear section thereto. The motor and reduction gear section are interposedly arranged between a pair of support plates. The motor includes a revolving shaft having a gear mounted thereon, which is engaged with one of the gears constituting the reduction gear section. The output shaft is provided thereon with a gear engaged with another one of the gears constituting the reduction gear section and arranged so as to project at the distal end thereof from one of the support plates.

In accordance with a further aspect of the present invention, an output distribution unit for a rotating drive device is provided. The unit includes a casing, a single input section arranged in the casing and provided with an input connection, and a plurality of output sections arranged in the casing and each provided with an output connection. The input section and output sections comprises gears engaged with each other.

Accordingly, it is an object of the present invention to provide a rotating drive device which is capable of exhibiting a variety of applications and/or diversities.

It is another object of the present invention to provide a rotating drive device which is capable of exhibiting various kinds of applications with a simple structure.

It is a further object of the present invention to provide a rotating drive device which is capable of being readily assembled.

It is still another object of the present invention to provide a rotating drive device which is capable of being significantly small-sized.

It is yet another object of the present invention to provide an output unit for a rotating drive device which is capable of a variety of applications and/or diversities with a simple structure.

It is even another object of the present invention to provide an output unit for a rotating drive device which is capable of being substantially small-sized.

It is still a further object of the present invention to provide an output unit for a rotating drive device which is capable of being easily assembled.

It is yet a further object of the present invention to provide an output distribution unit for a rotating drive device which is capable of exhibiting various kinds of applications and/or diversities with a simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENTS

Figure 1:
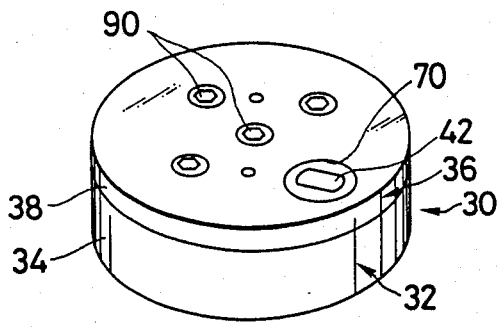
FIG. 1 is a perspective view showing an embodiment of a rotating drive device according to the present invention.
Figure 2:
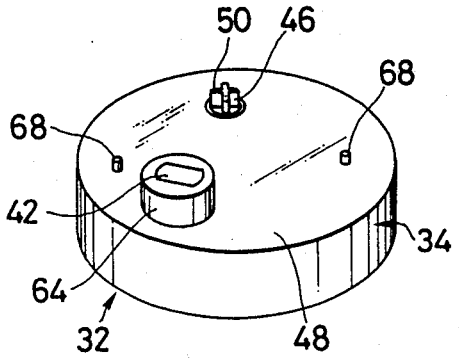
FIG. 2 is a perspective view showing a drive mechanism unit constituting a part of the rotating drive device shown in FIG. 1.
Figure 3:
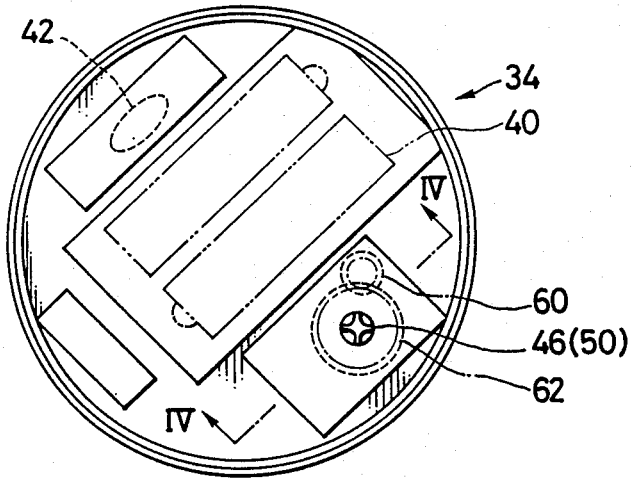
FIG. 3 is a plan view showing an internal structure of the drive mechanism unit shown in FIG. 2.
Figure 4:
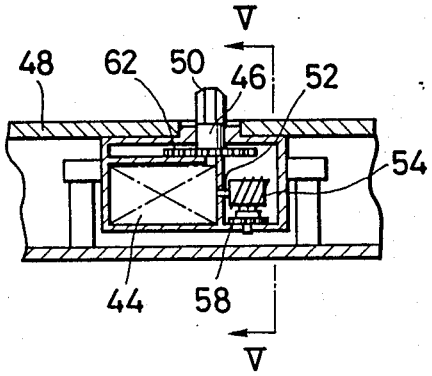
FIG. 4 is a sectional view taken along line IV—IV of FIG. 3.
Figure 5:
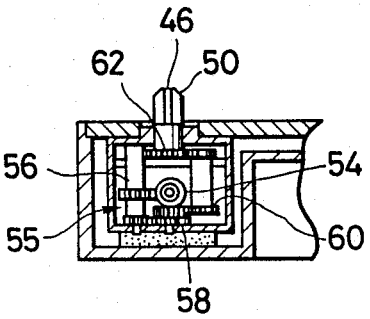
FIG. 5 is a sectional view taken along like V—V of FIG. 4.

Now, a rotating drive device according to the present invention will be described hereinafter with reference to the accompanying drawings.

FIGS. 1 to 11 generally show an embodiment of a rotating drive device according to the present invention. A rotating drive device of the illustrated embodiment generally designated by reference numeral 30 generally includes a drive mechanism unit or reduction motor unit 32 constructed in the form of a unit by means of a casing 34 and serving as an output unit and a transmission mechanism 36 likewise constructed in the form of a unit by means of a casing 38 and serving as an output distribution unit.

The drive mechanism unit or reduction motor unit 32 acting as the output unit, as shown in FIGS. 2 to 6, includes a power supply 40, a sensor 42 for detecting an external stimulus such as sound, light, ultrasonic wave or the like, and a motor 44 controllably actuated depending on the actuation of the sensor 42 which are arranged in the drive casing 34. To the motor 44 is operatively connected an output shaft or drive shaft 46 upwardly extending from an upper plate 48 of the casing 34, which is provided at the upper or distal end thereof with a cross-like connection 50.

The motor 44 includes a revolving shaft 52, on which a gear 54 is mounted. In the illustrated embodiment, the gear 54 is in the form of a worm gear. The worm gear 54 is operatively connected to a reduction gear section 55 comprising a first reduction gear 56, a second reduction gear 58 and a third reduction gear 60. More particularly, it is operatively connected to the first, second and third reduction gears 56, 58 and 60 in turn. The third reduction gear 60 is engaged with a gear 62 mounted on the output shaft or drive shaft 46. In the illustrated embodiment, a sound sensor is used as the sensor 42 which is adapted to actuate upon detection of sound of a predetermined level or more. The sensor 42 is received in a sensor housing 64.

Figure 6:
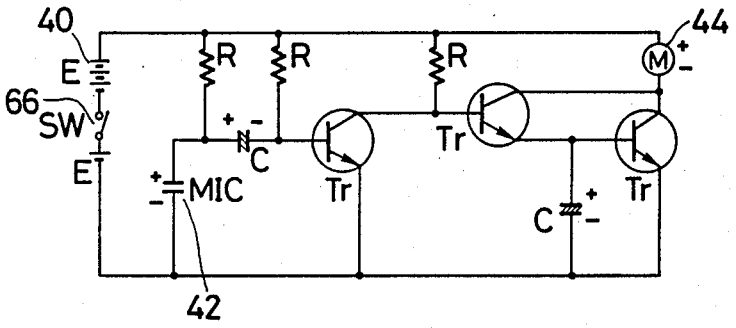
FIG. 6 is a circuit diagram showing an electrical circuit for a motor.
Figure 7:
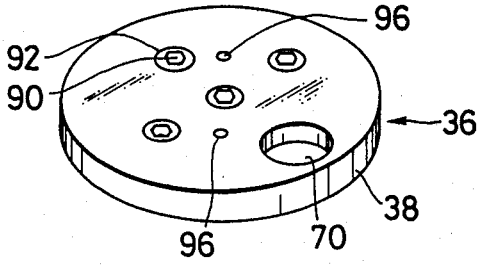
FIG. 7 is a perspective view showing a transmission mechanism unit constituting a part of the rotating drive device shown in FIG. 1.
Figure 8:
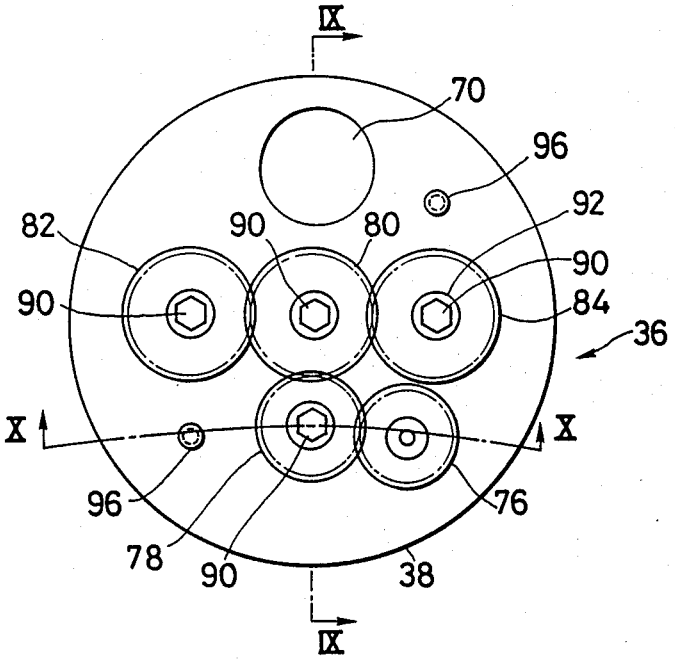
FIG. 8 is a plan view showing an internal structure of the transmission mechanism unit shown in FIG. 7.
Figure 9:
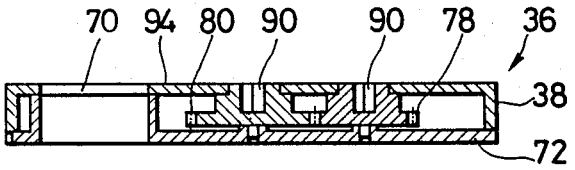
FIG. 9 is a sectional view taken along line IX—IX of FIG. 8.

The motor 44 is constructed so as to actuate when the sensor 42 detects sound while a switch for the power supply 40 is turned on, as shown in FIG. 6. The upper plate 48 of the drive casing 34 is provided thereon with two projections 68.

Figure 10:
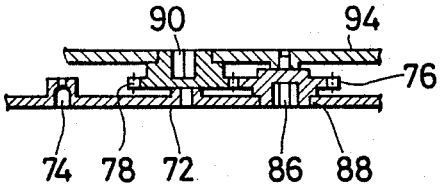
FIG. 10 is a sectional view taken along line X—X of FIG. 8.
Figure 11:
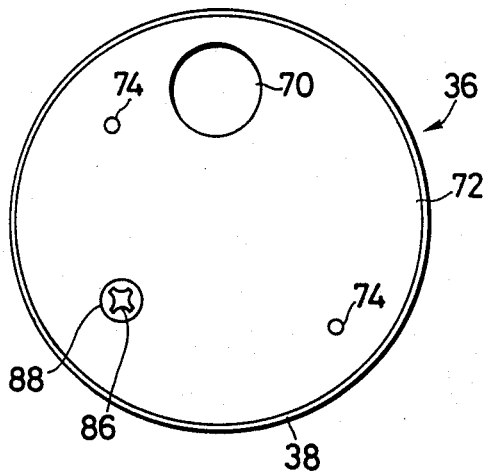
FIG. 11 is a bottom view of the transmission mechanism unit shown in FIG. 7.

The casing 38 of the transmission mechanism unit or output distribution unit 36, as shown in FIGS. 7 to 11, is provided with a vertical fit-on through-hole 70 in which the sensor housing 64 is fitted so that it is fittedly placed on the transmission mechanism unit 36. Also, the casing 38, as clearly shown in FIG. 11, includes a lower wall 72 which is provided with two recesses 74 in a manner to positionally correspond to the projections 68, so that the projections 68 may be fitted in the recesses 74 when the unit 36 is properly put on the unit 32, resulting in both units being securely connected together. In the casing 38 is arranged an input gear 76 to which the rotation of the output shaft 46 is transmitted, resulting in serving as the input section of the transmission mechanism unit 36. Also, the transmission mechanism unit 36 includes four gears 78, 80, 82 and 84 received in the casing 38 which serve as the output section of the unit 36. The gear 76, as shown in FIG. 10, is formed on the lower surface thereof with a cross-like groove 86 fittedly engaged with the cross-like distal end 50 of the output shaft 46 of the transmission mechanism unit 36. The cross-like groove 86 is opened to the lower wall 72 of the casing 38 through an opening 88 formed at the lower wall 72. The input gear 76 is engaged with the first gear 78, which is then engaged with the second gear 80. The gear 80 is then engaged with both third and fourth gears 82 and 84. The gears 76, 78, 80, 82 and 84 each are formed on the central portion of the upper surface thereof with a polygonal recess 90 which is opened to an opening 92 formed at an upper wall 94 of the transmission casing 38 in a manner to correspond to each of the recesses 90. The upper wall 94 of the transmission casing 38 is formed with holes 96.

In the rotating drive device 30 constructed as described above, the transmission casing 38 is put on the drive casing 34 and then the sensor housing 64 of the casing 34 is fitted in the fit-on through-hole 70 of the transmission casing 38. Then, the projections 68 of the casing 34 are engagedly fitted in the recesses 74 of the casing 38. This causes both casings 34 and 38 to be connected together, so that the cross-like end 50 of the output shaft 46 of the drive mechanism unit 36 is fittedly engaged with the cross-like groove 86 of the input gear 76 of the transmission mechanism unit 36.

Then, when the sensor 42 detects sound of a predetermined level or more, the motor 44 drives to output a revolving force, which is then transmitted through the reduction gears 56, 58 and 60 to the output shaft 46, resulting in rotating the output shaft 46. The rotation of the output shaft 46 is transmitted to the input gear 76 of the transmission mechanism unit 36 to rotate the gear 76, so that the first to fourth gears 78 to 84 may be concurrently rotated.

As can be seen from the foregoing, the rotating drive device of the illustrated embodiment is so constructed that the drive mechanism unit 32 and transmission mechanism unit 36 are separately constructed, and the mutual operative connection between the output shaft 46 of the drive mechanism unit 32 and the input section of the transmission mechanism unit 36 is carried out through the engagement therebetween or the like. Such construction permits both units to be positionally varied relative to each other at positions other than the position at which the mutual connection is currently carried out. Also, the transmission mechanism unit 36 is provided with a plurality of the output sections, so that at least a part of the output sections may be selected for moving a movable decoration as desired. Thus, it will be noted that the illustrated embodiment permits a plurality of decorations to be concurrently moved with different rotational speeds.

Figure 13:
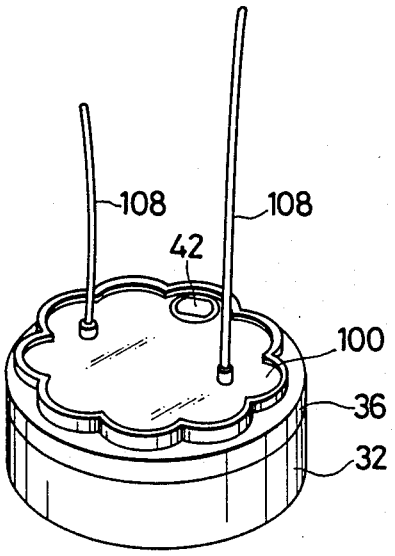
FIG. 13 is a fragmentary perspective view showing a decoration base for the movable decorative ornament shown in FIG. 12.
Figure 14:
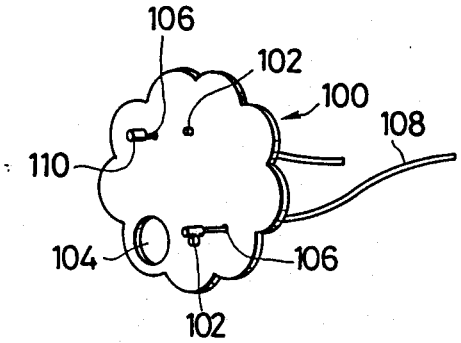
FIG. 14 is a perspective view of the decoration base shown in FIG. 13.
Figure 12:
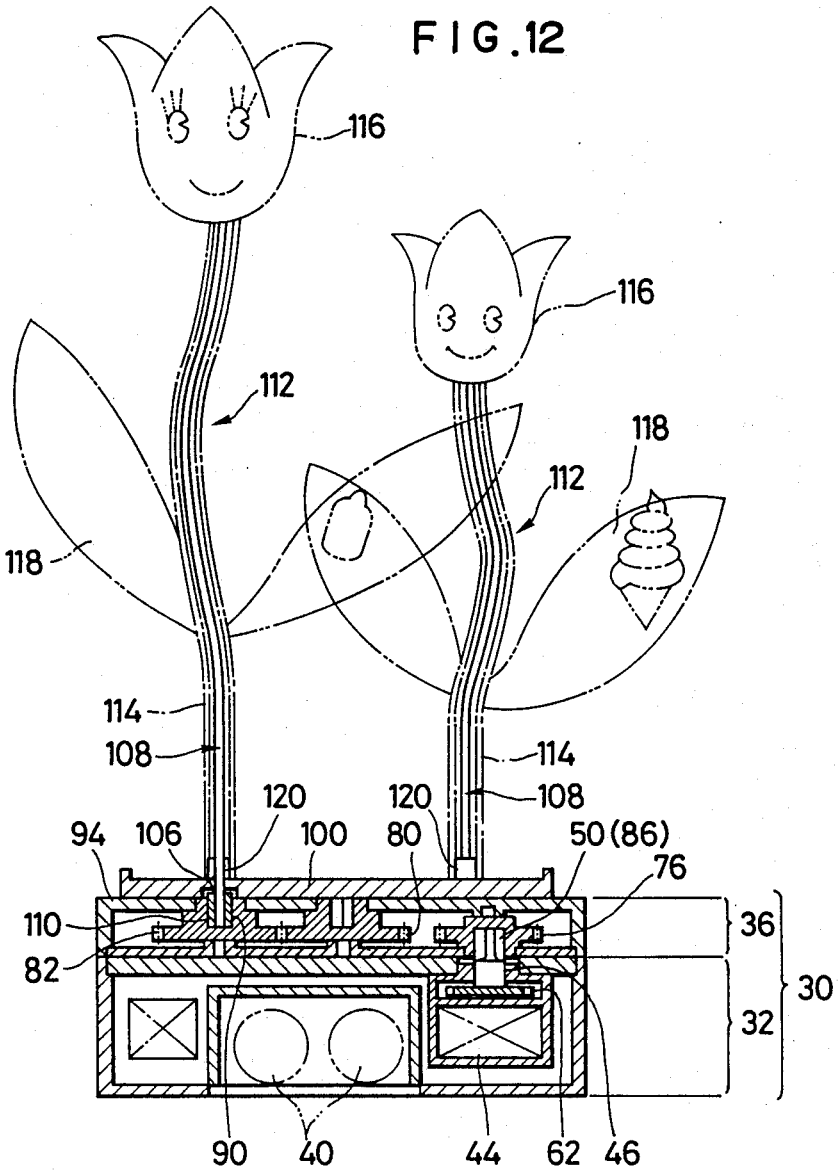
FIG. 12 is a vertical sectional view showing an example of a movable decorative ornament to which the rotating drive device shown in FIG. 1 is applied.

FIGS. 12 to 14 show an example wherein the rotating drive device of the illustrated embodiment is applied to a movable decorative ornament or toy. Reference numeral 100 designates a decoration base in the form of a plate, which is formed on the lower surface thereof with projections 102 adapted to be fitted in the holes 96 of the upper wall 94 of the transmission casing 38 when it is placed on the casing 38, resulting in securely mounted on the casing 38. Also, the base plate 100 is formed with a fit-on hole 104 in which the sensor housing 64 is fitted. Further, the base plate 100 has holding holes 106 formed therethrough corresponding in number and position to at least two of the four output gears 78, 80, 82 and 84 of the transmission mechanism unit 36. In the illustrated embodiment, such two holes 106 are formed through the base plate 100 in correspondence to the output shafts 82 and 84. Through the holding holes 106 are rotatably inserted two core elements 108 in the form of a wire. The core elements 108 may be made of a flexible or deformable material such as a metal wire and are bent or curved into a meandering shape. The core elements 108 each are formed at the lower end thereof with a projection 110 engagedly fitted in the recess 90 of the output gear 82 (84).

On each of the core elements 108 is fitted a decoration in the form of a tulip which includes a hollow stem 114 and a flower body 116 mounted on the upper end of the stem 114. The stem 114 may be provided with a suitable number of leaves 118. The hollow stems 114 each are loosely fitted on the core element 108 and tightly or fixedly fitted at the lower end thereof on a hollow cylinder 120 mounted on the base plate 100 in alignment with or in a manner to communicate with the holding hole 106 of the plate 100.

Thus, when the decoration base plate 100 is mounted on the transmission casing 38, the projections 110 of the core elements 108 are engagedly fitted in the recesses 90 of the output gears 82 and 84, resulting in the core elements being operatively connected to the gears. This causes the core elements 108 to be rotated with the rotation of the gears. More particularly, when the sensor 42 detects sound of a predetermined level or more to lead to the driving of the motor 44, the core elements 108 are rotated through the output gears 82 and 84. This results in the decorations 112 being moved in a meandering manner without any rotation with the rotation of the core elements 108 because the stems 114 of the decorations are loosely fitted on the core elements.

Decoration bases 100 each of which is formed with holding holes 106 different in position and number from the holding holes 106 of the above-described decoration base 100 may be substituted therefor. This permits the movable decorative ornament to give a viewer different interest and surprise.

The decoration base 100 may be formed integral with the transmission casing 38.

The rotating drive device of the illustrated embodiment may include only one core element 108.

Figure 15:
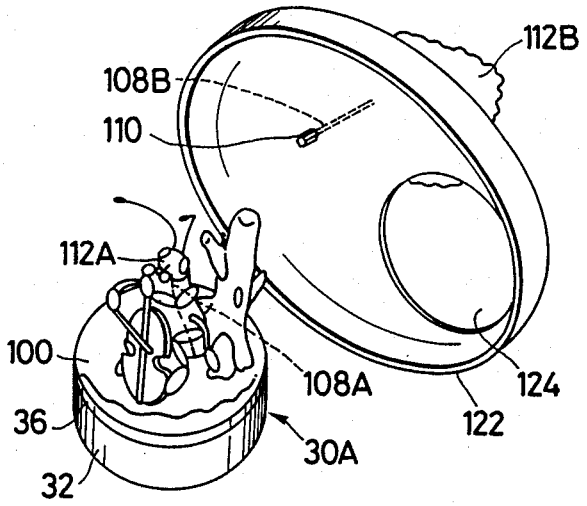
FIGS. 15 and 16 are perspective views showing another example of a movable decorative ornament to which the rotating drive device shown in FIG. 1 is applied.
Figure 16:
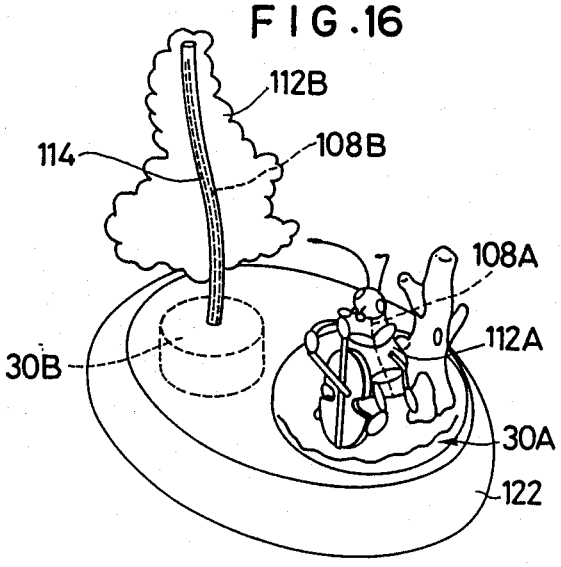

FIGS. 15 and 16 show another example of application of the rotating drive device of the illustrated embodiment to a movable decorative ornament, wherein two rotating drive devices 30 (30A, 30B) of the illustrated embodiment each including the single core element 108 (108A, 108B) operatively connected to any one of the output gears 78 to 84 such as, for example, the output gear 78 in the above-described manner are used. A decoration 112A in the form of an insect is mounted on a decoration base 100 and fitted on the core elements 108A in substantially the same manner as described above. The rotating drive device 30A on which the decoration base 100 is mounted is then covered with a cover 122 formed with an opening 124 through which the decoration 112A is outwardly projected or exposed from the cover 122. The rotating drive device 30B is arranged adjacent to the rotating drive device 30A in the cover 122 and the core element 108B is arranged so as to upwardly extend through the cover 122 and be rotatable with respect to the cover 122, on which a decoration 112B in the form of a tree is fitted. In the so-constructed movable decorative ornament, when the switch 66 of each of the rotating drive devices is turned on while a music is being played, the sensor 42 senses sound of the music to simultaneously drive the decorations 112A and 112B, so that a viewer may be impressed as if the decoration 112A plays the music and the decoration 112B nods depending on the playing of the decoration 112A.

The core elements 108A and 108B of the rotating drive devices 30A and 30B each may be selectively connected to any one of the remaining output gears 80, 82 and 84 in place of the output gear 78. This causes the movable decorative ornament to carry out a variety of different motions.

Figure 17:
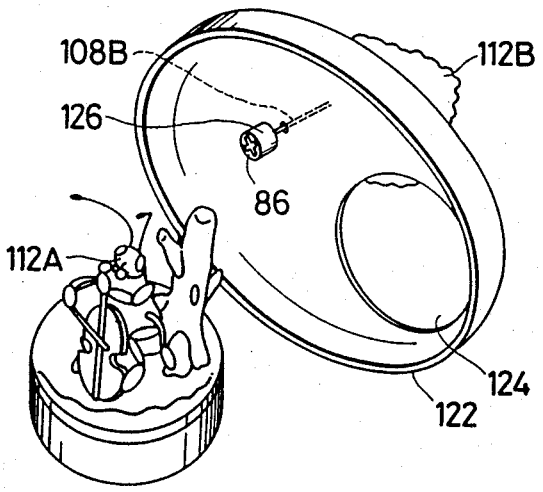
FIGS. 17 and 18 are perspective view showing an example of a movable decorative ornament to which another embodiment of a rotating drive device according to the present present invention is applied.
Figure 18:
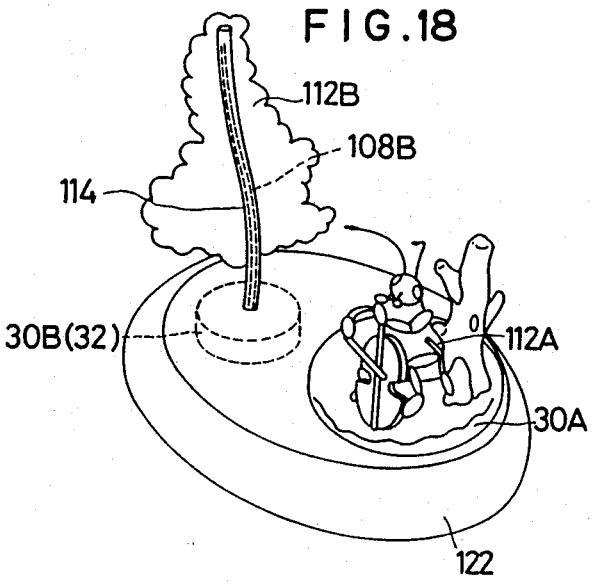

In accordance with another aspect of the present invention, the core element may be operatively connected directly to the drive mechanism unit, as shown in FIGS. 17 and 18. Accordingly, the rotating drive device only comprising the drive mechanism unit is included in the scope of the present invention.

FIGS. 17 and 18 show a movable decorative ornament constructed in substantially the same manner as that shown in FIGS. 15 and 16, except that a core element for driving a decoration in the form of a tree is operatively connected directly to the drive mechanism unit of the present invention without using the transmission mechanism unit.

More particularly, a decoration 112B in the form of a tree includes a hollow stem 114 mounted on a decoration cover 122 and loosely fitted on a core element 108B projected at the upper portion thereof from the rear surface of the decoration cover 122. On the lower end of the core element 108B is mounted a connection 126 which is provided with a cross-like groove 86 fittedly engaged with a cross-like end of an output shaft (not shown) of a drive mechanism unit 32 constructed as described above. Thus, as shown in FIGS. 17 and 18, a rotating drive device 30B comprising only the drive mechanism unit 32 is arranged adjacent to a rotating drive device 30A in the decoration cover 122 to engage the cross-link end of the output shaft of the drive mechanism unit 32 with the the cross-link groove 86 of the connection 126 of the core element 108B. The rotating drive device 30A and a decoration 112A may be constructed in substantially the same manner as in FIGS. 15 and 16.

Thus, in the movable decorative ornament shown in FIGS. 17 and 18, when a switch of each of the rotating drive devices is turned on while a music is being played, a sensor detects sound of the music to simultaneously drive the decorations 112A and 112B, so that a viewer may be impressed as if the decoration 112A plays the music and the decoration 112B nods depending on the playing of the decoration 112A. Thus, it will be noted that the movable decorative ornament exhibits substantially the same motion as that shown in FIGS. 15 and 16.

Figure 19:
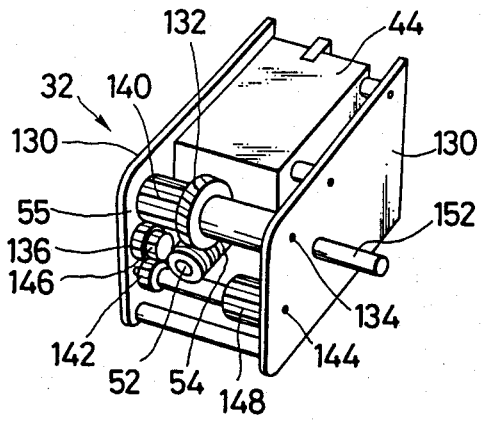
FIG. 19 is a perspective view showing an example of a reduction motor unit for a rotating drive device according to the present invention.
Figure 20:
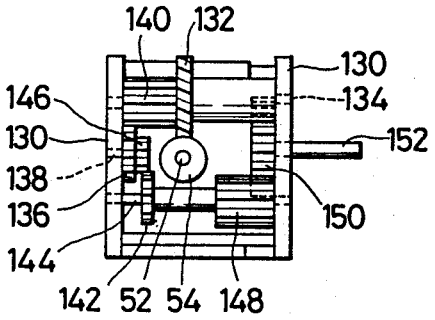
FIG. 20 is a front elevation view of the reduction motor unit shown in FIG. 19.
Figure 21:
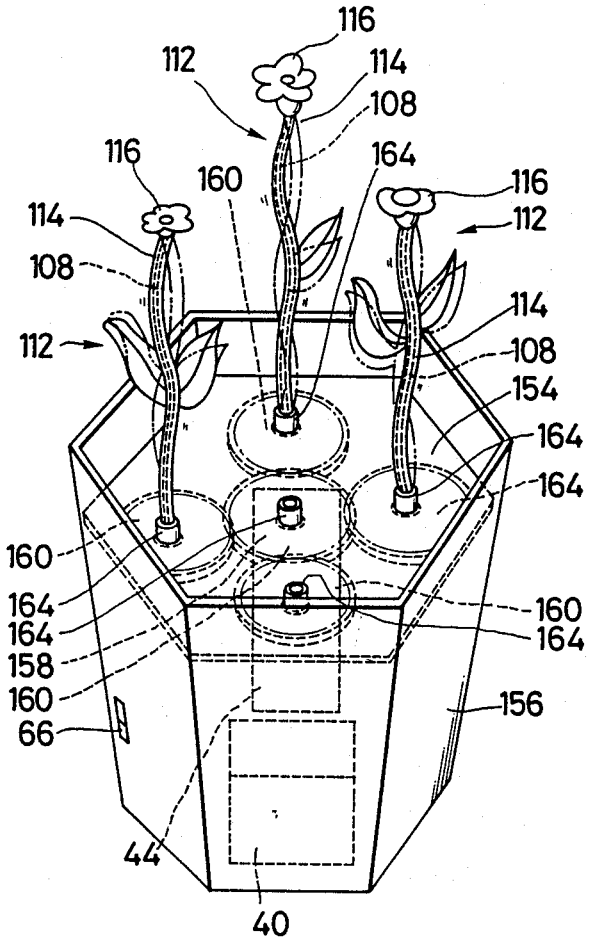
FIG. 21 is a perspective view showing a movable decorative ornament in which the reduction motor unit shown in FIG. 19 is incorporated.

The the drive mechanism unit or reduction motor unit 32 serving as the output unit may be constructed as shown in FIGS. 19 to 21.

A reduction motor unit 32 shown in FIG. 19 to 21 includes a motor 44 and a reduction gear section 55 comprising a plurality of gears to which the drive force of the motor is transmitted in turn. The motor 44 and reduction gear section 55 are interposedly supported between a pair of support plates 130.

The reduction gear section 55 includes a gear 132 mounted on a support shaft 134 and engaged with a gear 54 mounted on a revolving shaft 52 of the motor 44, a gear 136 supported on a support shaft 138 and engaged with a gear 140 mounted on the support shaft 135 in juxtaposition with the gear 132, a gear 142 supported on a support shaft 144 and engaged with a gear 146 supported on the support shaft 138 in juxtaposition with the gear 136, and a gear 148 mounted on the support shaft 144 in juxtaposition with the gear 142. With the gear 148 is engaged a gear 150 mounted on the proximal end of a drive shaft or output shaft 152.

The drive shaft 152 is arranged in a manner to extend in a direction perpendicular to the output shaft 52 of the motor 44 and project at one end thereof from one of the support plates 130.

In the reduction motor unit 32 constructed as described above, the gear 54 mounted on the output shaft 52 of the motor 44 is rotated with the actuation of the motor 44. The gear 54 is engaged with the gear 132 which is one of the gears constituting the reduction gear section 55, resulting in actuating the reduction gear section 55. The gear 148 of the reduction gear section 55 is engaged with the gear 150 mounted on the drive shaft 152, to thereby cause the drive shaft 152 to be rotated.

The reduction motor unit 32 thus constructed and operated may be used, for example, in such a manner as shown in FIG. 21. More particularly, the reduction motor unit 32 may be mounted on the lower surface of a support plate 154 formed into a hexagonal shape and arranged in an upper portion of a flowerpot 156 and the drive shaft 152 of the rotating drive device is provided with a gear 158. On the rear surface of the support plate 154 are arranged four gears 160 at equal intervals so as to be concurrently engaged with the gear 158. Then, a curved core element 108 made of a deformable wire material is engagedly mounted on the central portion of the upper surface of each of the gears 160 so as to upwardly extend therefrom through the support plate 154. Subsequently, a decoration 112 made in imitation of a flower which includes a hollow stem 114 and a flower body 116 mounted on the distal end of the hollow stem 114 is loosely fitted on each of the core elements 108. More particularly, the hollow stem 114 of each of the flower decorations 112 is fitted on the core element 108 and securely fitted at the lower or proximal end thereof on a cylindrical support 164 mounted on the upper surface of the support plate 154 through which the core element is loosely inserted. Thus, the rotation of the curved core elements 108 causes the stems 114 of the decorations loosely fitted on thereon to be meanderingly moved, resulting in giving a viewer unexpected surprise and interest.

In FIG. 21, reference numerals 40 and 66 designate a power supply and a switch, respectively.

As described above, the drive mechanism unit or output unit 32 in the form of a reduction motor unit shown in FIGS. 19 and 20 is so constructed that the motor 44 and the reduction gear section 55 are arranged between the support plates 130, resulting in easily assembled and significantly small-sized. For example, the output unit 32 may be formed into a rectangular parallelopiped shape having dimensions of about 18 mm in height, about 15 mm in width and about 31 mm in length. Also, the drive shaft 152 is arranged in a manner to be perpendicular to the output shaft 52 of the motor 44 and outwardly project from one of the support plates 130, to thereby permit the reduction motor unit to be used for a toy of small dimensions.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A rotating drive device comprising:

a drive mechanism unit including a casing, a power supply, a sensor, and a motor each arranged in said casing, and an output shaft operatively connected to said motor, said motor being electrically connected to said power supply and sensor so as to be actuated when said sensor detects an external stimulus, and a transmission mechanism unit detachably connected to said drive mechanism unit through said output shaft, said transmission mechanism unit including an input section operatively connected to said output shaft of said drive mechanism unit to transmit the power of said drive mechanism unit to said transmission mechanism unit and a plurality of output sections for transmitting the power of said transmission mechanism unit to the exterior.

2. A rotating drive device as defined in claim 1 wherein said output sections are formed into a substantially rectangular parallelepiped having dimensions of about 18 mm in height, about 155 mm in width, and about 31 mm in length.

3. A rotating drive device as defined in claim 1 wherein said input section and output sections comprise gears engaged with each other.

4. A rotating drive device comprising:

a drive mechanism unit including a casing, a power supply, a sensor, and a motor each arranged in said casing, and an output shaft operatively connected to said motor, said motor being electrically connected to said power supply and sensor so as to be actuated when said sensor detects an external stimulus;

a transmission mechanism unit including a transmission casing operatively connected to said drive mechanism unit through said output shaft, said transmission mechanism unit including an input section operatively connected to said output shaft of said drive mechanism unit to transmit the power of said drive mechanism unit to said transmission mechanism unit and a plurality of output sections for transmitting the power of said transmission mechanism unit to the exterior;

a decoration base mounted on said casing of said transmission mechanism unit, and at least one core element rotatably mounted on said decoration base and formed with a connection adapted to be operatively connected to any one of said output sections of said transmission mechanism unit when said decoration base is mounted on said casing.

* * * * *